United States Patent [19]

Ariel

[11] Patent Number: 4,544,154

[45] **Date of Patent: * Oct. 1, 1985**

[54] PASSIVE PROGRAMMABLE RESISTANCE DEVICE

[75] Inventor: Gideon B. Ariel, Belchertown, Mass.

[73] Assignee: Pepsico, Inc., Purchase, N.Y.

[ * ] Notice: The portion of the term of this patent subsequent to Oct. 19, 1999 has been disclaimed.

[21] Appl. No.: 372,178

[22] Filed: Apr. 26, 1982

Related U.S. Application Data

[63] Continuation-in-part of Ser. No. 949,237, Oct. 13, 1978, Pat. No. 4,354,676.

[51] Int. Cl.[4] ..... A63B 21/24

[52] U.S. Cl. ..... 272/129; 272/130; 73/745; 73/379; 417/545

[58] Field of Search ..... 272/129-131, 272/134, DIG. 4-DIG. 6, DIG. 7; 73/744, 745, 379; 417/545; 364/424; 91/275; 901/9, 22, 34

[56] References Cited

U.S. PATENT DOCUMENTS

| | | | |
|---|---|---|---|
| 3,848,467 | 11/1974 | Flavell | 272/129 |
| 3,991,393 | 11/1976 | Becker | 73/745 |
| 4,063,726 | 12/1977 | Wilson | 272/129 |
| 4,148,203 | 4/1979 | Farazandeh et al. | 100/46 |
| 4,279,162 | 7/1981 | Neill et al. | 73/746 |
| 4,354,676 | 10/1982 | Ariel | 272/129 |
| 4,403,919 | 9/1983 | Stanton et al. | 91/275 |
| 4,426,911 | 2/1980 | Robinson et al. | 91/499 |
| 4,468,739 | 8/1984 | Woods et al. | 364/424 |

*Primary Examiner*—Richard C. Pinkham
*Assistant Examiner*—MaryAnn Stoll Lastova

[57] ABSTRACT

A passive programmable resistance device uses a closed loop feedback for controlling resistance to rotational or translational motion of an object. One or more actual parameters, such as force or position, are measured and compared with desired parameters. The differences are used to provide a control signal which controls the resistance to the movement of the object.

5 Claims, 19 Drawing Figures

DATA ADDRESS & CONTROL BUSS

| | | | |
|---|---|---|---|
| GND | 1 | A | A11 |
| +5V | 2 | B | A12 |
| D5 | 3 | C | A10 |
| D7 | 4 | D | A13 |
| D6 | 5 | E | A9 |
| D4 | 6 | F | A14 |
| D3 | 7 | H | A8 |
| D2 | 8 | J | A15 |
| D1 | 9 | K | A7 |
| DØ | 10 | L | A6 |
| -12V | 11 | M | A5 |
| +12V | 12 | N | A4 |
| $\overline{\text{RAM SEL}}$ | 13 | P | A3 |
| | 14 | R | A2 |
| $\overline{\text{SEL 12}}$ | 15 | S | A1 |
| ROM EN2 | 16 | T | A0 |
| ROM EN1 | 17 | U | B.A. |
| $\overline{\text{VMA·Ø2}}$ | 18 | V | R/$\overline{\text{W}}$ |
| $\overline{\text{BUS Ø2}}$ | 19 | W | $\overline{\text{NMI}}$ |
| | 20 | X | $\overline{\text{TRQ}}$ |
| +5V | 21 | Y | $\overline{\text{HALT}}$ |
| GND | 22 | Z | $\overline{\text{RESET}}$ |

FIG. 4a

I/O BOARD

| | | | |
|---|---|---|---|
| GND | 1 | A | $\overline{\text{CW STEP}}$ |
| +5V | 2 | B | A12 |
| D5 | 3 | C | $\overline{\text{CCW STEP}}$ |
| D7 | 4 | D | A13 |
| D6 | 5 | E | MEM R/W |
| D4 | 6 | F | A14 |
| D3 | 7 | H | MEM Ø |
| D2 | 8 | J | A15 |
| D1 | 9 | K | MEM 1 |
| DØ | 10 | L | MEM 2 |
| -12V | 11 | M | A5 |
| +12V | 12 | N | A4 |
| $\overline{\text{RAM SEL}}$ | 13 | P | A3 |
| | 14 | R | A2 |
| $\overline{\text{SEL 12}}$ | 15 | S | A1 |
| ROM EN2 | 16 | T | A0 |
| ROM EN1 | 17 | U | B.A. |
| $\overline{\text{WMA·Ø2}}$ | 18 | V | R/$\overline{\text{W}}$ |
| $\overline{\text{BUS Ø2}}$ | 19 | W | $\overline{\text{NMI}}$ |
| | 20 | X | $\overline{\text{TRQ}}$ |
| +5V | 21 | Y | -5V |
| GND | 22 | Z | $\overline{\text{RESET}}$ |

FIG. 4b

MEMORY BUSS

| | | | |
|---|---|---|---|
| GND | 1 | A | GND |
| GND | 2 | B | GND |
| +5V | 3 | C | +5V |
| A11 | 4 | D | A10 |
| A9 | 5 | E | A8 |
| A7 | 6 | F | A6 |
| D5 | 7 | H | D7 |
| D6 | 8 | J | D4 |
| | 9 | K | |
| SEE TABLE | 10 | L | |
| | 11 | M | |
| MEM R/W | 12 | N | |
| MEM R/W | 13 | P | |
| | 14 | R | |
| D3 | 15 | S | D2 |
| D1 | 16 | T | DØ |
| A5 | 17 | U | A4 |
| A3 | 18 | V | A2 |
| A1 | 19 | W | AØ |
| +5V | 20 | X | +5V |
| GND | 21 | Y | GND |
| GND | 22 | Z | GND |
| SIGNAL | PIN | PIN | SIGNAL |

FIG. 4c

| PIN 10 USAGE | |
|---|---|
| SLOT | SIGNAL |
| 4 | MEM Ø |
| 5 | MEM 1 |
| 6 | MEM 2 |
| | |

TABLE A

| ADDRESS | DEVICE |
|---|---|
| D004 + D005 | DISPLAY |
| D008 - D00B | PIA #Ø |
| D010 | MOTOR CW |
| D020 | MOTOR CCW |
| D040 - D043 | |
| D080 - D083 | |
| D100 - D103 | |

TABLE B

| ADDRESS | DEVICE |
|---|---|
| EE08 + EE09 | ACIA |
| EE10 - EE13 | PIA #1 |
| EE20 - EE23 | PIA #2 |
| EE40 - EE43 | |
| EE80 - EE83 | |
| EF00 - EF03 | |

PASSIVE PROGRAMMABLE RESISTANCE DEVICE

RELATED APPLICATION

This application is a continuation-in-part of U.S. patent application Ser. No. 949,237, (now U.S. Pat. No. 4,354,676) filed Oct. 13, 1978.

BACKGROUND AND SUMMARY

This invention relates to a passive programmable resistance device, and, more particularly, to a resistance device which utilizes closed loop feedback to control the movement of an object. Such a device can be utilized in numerous and varied fields. For example, my prior U.S. patent application Ser. No. 949,237, (now U.S. Pat. No. 4,354,676) filed Oct. 13, 1978 describes the use of a passive programmable resistance device in an exercise machine to control the movement of the exercise bar.

In the broadest sense, the resistance device can be used to increase accuracy and smoothness of a process involving motion of a mechanical system, to provide a braking or cushioning effect, or a regulated means to dissipate mechanical energy. For example, industrial and manufacturing procedures frequently use robotics for performing certain operations. A passive programmable resistance device could be incorporated in a robot to control the movement of the robot.

The invention provides a controlled programmable resistance to motion of a mechanical system utilizing passive hydraulic components. A computer or microcomputer is utilized to provide programmable controlled feedback to the hydraulic components.

This system for controlling resistance does not require any active hydraulics, such as pumps or other power sources, and requires very few mechanical components. When using the invention in an exercise machine, for example, the result is an inherently safe means for controlling exercise.

The basic principle of the invention is a closed loop feedback process. Once a specific resistive function for which the controller is programmed has been selected, the feedback process can be broken down into steps as follows:

1. At regular intervals input signals appropriate for the specified control function are read by the computer or microcomputer. Signals include one related to the force on the mechanical system and/or one related to the position or orientation of the mechanical system.

2. If needed, velocity of the mechanical system can be calculated from position input over time, and compensations and corrections can be made to the input and quantities to account for non-linearity in the system and effects of mechanical geometry.

3. Based on quantities after all corrections have been made, the computer or microcomputer determines a feedback action to be applied to a hydraulic control valve.

4. As a result of closed loop feedback control of the valve positon, control of the resistive force as measured at an appropriate point on the mechanical assembly is accom- plished.

5. The control feedback process is repeated at regular intervals, steps 1 through 4.

The function of the computer or microcomputer in this invention is that of reading the signals related to force and/or position. From this information, and as a result of the programmed control function, a feedback output to the system is calculated. This feedback is then input to the motor controlling the valve. The computer or microcomputer can thus be viewed as a black box which performs a specified control/feedback function.

There are other means to perform the control/feedback function not involving computers or microcomputers. However, any of these means not using a programmable computer device would not have the degree of flexibility possessed by the present invention. When utilizing a microcomputer in this invention, a level of economy can be achieved not possible with other devices.

A central feature in the design of this invention is the feedback algorithm. Once the input signals have been translated to numerical quantities, calculation of the feedback takes place. In general, a description of the feedback function is:

$$\text{FEEDBACK} = F\ (\text{Force, Position, Time})$$

Different control requirements require different algorithms as do different machine geometries and different hydraulic components. A typical control requirement might require a resistance held to a predetermined force or velocity. For example, a simple feedback algorithm which will control a force begins by first determining the difference between the actual observed force and the force which is desired:

$$S = k(fd - fa)$$

Where

S = the numerical value of the feedback output,
k = a constant,
fd = desired force,
fa = actual force.

This feedback function is a linear function where the constant k is determined while considering the specific hydraulic and mechanical system utilized.

A feedback function similar to the one described can be utilized to control velocity, rather than force. To accomplish this control, desired and actual forces would be replaced with desired and actual velocities.

Other more eloborate feedback algorithms can be developed which can better serve specific purposes. The example given does function well and is a useful and simple illustration of the principle.

There are a multitude of other feedback functions which can perform useful control functions. There are certain types of useful control functions which cannot be readily expressed with a single concise equation. An example of one such control function is called the "stickpoint function." A "stickpoint" control function might be defined as a control function which at some point abruptly changes the resistance to the maximum amount. The resistance is at a maximum for a specific period of time, after which the resistance returns to a level dictated by the background control function. The background control function can be any control function regulating force, velocity, or acceleration.

Other advantages accrue from incorporating a computer or microcomputer in the control system. For example, during those times the computer is not engaged in the actual control and feedback activity, the processor may, as required perform other useful activities in the system. These activities can include recording or display of relevant data of the control process. Note that these activities are not directly linked to the feedback process itself. When incorporating a microcomputer in the described control process, it also becomes possible to easily use this invention as a part of a larger system which incorporates many more processors or sensors. Applications which may benefit from this approach include those in robotics and those relating to industrial processes.

DESCRIPTION OF THE DRAWINGS

The invention will be explained in conjunction with illustrative embodiments shown in the accompanying drawing, in which

FIGS. 4*a*, *b* and *c* illustrate the assignment of signals on the buses of FIG. 1;

GENERAL DESCRIPTION OF THE INVENTION

Figure 10:
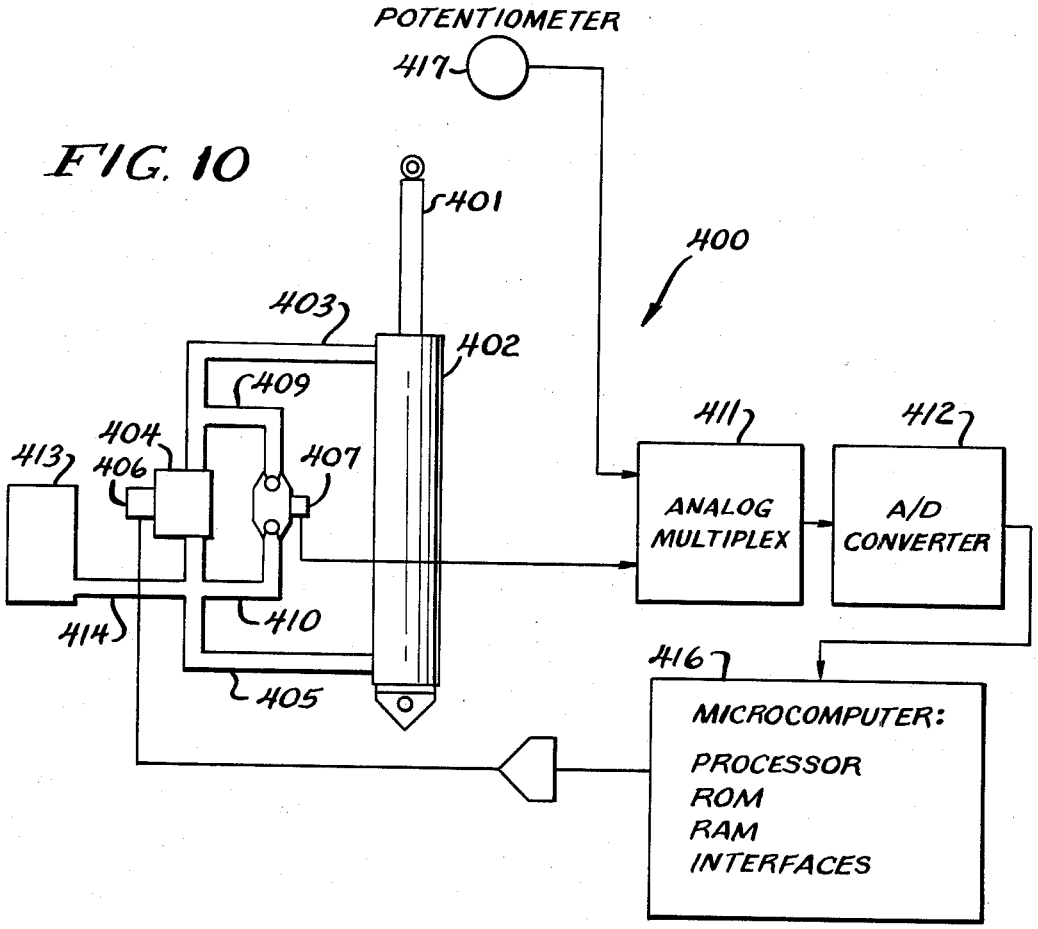
FIG. 10 illusrtates a passive programmable resistance device which can be used with a variety of mechanical systems.

Referring first to FIG. 10, the numeral 400 designates generally a passive programmable resistance device. A piston 401 is reciprocable within a hydraulic cylinder 402. A fluid conduit 403 connects the upper end of the cylinder to a hydraulic control valve 404, and a conduit 405 connects the lower end of the cylinder to the valve. The valve 404 is controlled by a motor 406 to open and close fluid flow between the conduits 403 and 405. A conventional stepper motor has been used to control the hydraulic valve.

A pressure transducer 407 is mounted in a housing 408, and the housing is connected to the conduits 403 and 405 by conduits 409 and 410. A check valve is mounted in the housing at the end of each of the conduits 409 and 410 so that the pressure transducer 407 can react to the hydraulic pressure within the hydraulic cylinder 402 regardless of the direction in which the piston 401 is moving. The pressure transducer converts fluid pressure information to an analog voltage which is passed to an analog multiplexer circuit 411 and an analog to digital converter 412.

A fluid reservoir 413 is connected by conduit 414 to the conduit 405 to compensate for the varying fluid volume inside the cylinder 402 as a result of movement of the piston shaft into and out of the cylinder. The reservoir also compensates for fluid leakage and temperature variations.

The analog voltage signal from the pressure transducer is converted to a digital signal by the converter 412. The digital signal is fed to a microcomputer system 416, which is conventional. The microcomputer includes a processor, a read only memory (ROM), a random access memoray (RAM), and interfaces.

Another signal is fed to the microcomputer which is related to the position of the mechanics. In the present system this signal is generated by a potentiometer 417 whose shaft is linked to the external mechanical assembly which is connected to the piston 201. This signal is thus also related to the position of the piston in the cylinder. The mechanical link between the potentiometer and the piston is not shown in FIG. 1.

Both the position and pressure signals in this embodiment of the invention are analog voltages. However, they need not be limited to this. The position of the mechanics could, for example, be generated by a rotary shaft encoder with a digital output.

In the embodiment illustrated in FIG. 10, these two input signals are multiplexed through a multiplexer 411 to a single analog to digital converter 412. A single analog signal the microcomputer 416. The selected signal is converted to a digital form by the analog to digital converter 412. The operation of the analog to digital converter is also controlled by the microcomputer.

Under control of the microcomputer, data from the tranducers 408 and 417 enters the microcomputer via an interface from the analog to digital converter. The analog inputs enter a feedback algorithm which generates an output feedback. In the present embodiment of the invention, this output consists of digital control signals to the stepper motor 406 which controls the valve 404. The direction of travel for the stepper motor and the number of motor steps in the given direction make up the entire feedback to the hydraulic system. A motor controller 418 translates the outputs from the microcomputer to the voltage level required for proper motor function.

If the stepper motor is moved in the direction which causes the hydraulic valve to restrict fluid flow, then the resistance to movement of the piston is increased. If the stepper motor is moved in the direction which opens the hydraulic valve, then resistance to movement of the piston is decreased.

Figure 11:
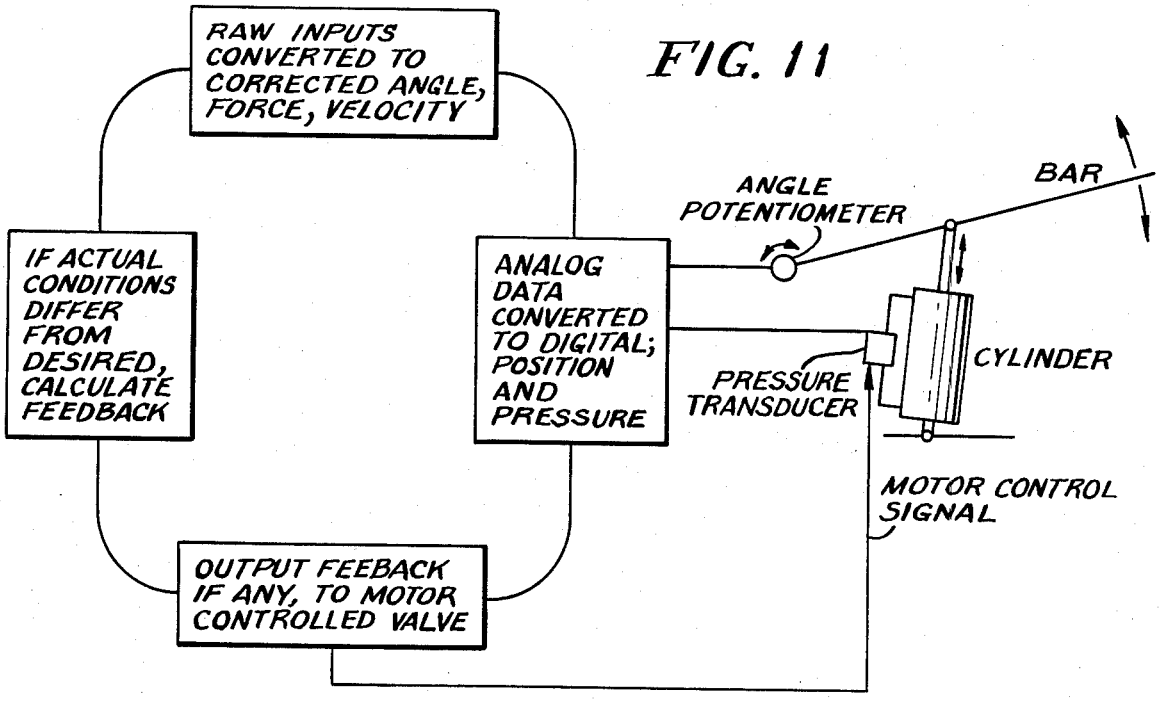
FIG. 11 illustrates a typical control feedback function for force control.

FIG. 11 illustrates a typical control feedback function using an information flow diagram. This flow diagram describes a feedback loop for force control. This flow diagram shows the time order of events in the feedback control as well as some of the decision logic. This type of feedback computation process is typical of a number of control functions of which the system is capable.

The feedback routine is executed at regular intervals. Once values for position and/or pressure are available to the microcomputer, the raw input can be scaled through multiplication by a constant, and any offset can be added. At this point velocity of the external mechanical system can be calculated from the position information at present and the position information from the previous time interval.

Any compensations for non-linearities anywhere in the system can be performed on the data at an appropriate time in the process. For example, one variation which must be considered is the different effective area the cylinder exerts on the fluid depending on the direction of travel of the piston. This is as a result of the location of the shaft on one side only of the piston.

Once all compensations have been performed, the feedback operation can occur. In this example, if the measured force equals the desired force, no feedback occurs through this cycle. If the actual measured force is greater than the desired force, the valve will close a calculated number of steps. If the actual measured force is less than the desired force, the valve is opened a calculated number of steps, as determined by the feedback algorithm. When the feedback operation has been completed, other activities required for the application can occur. These activities may occupy the processor until the next set of data is ready to be processed.

Variations of the invention can include use of a rotary hydraulic actuator in place of a cylinder. Such a substitution will have the same feedback loop structure, but will directly provide means to regulate resistance to rotary motion.

Numerous substitutions can also be made with the various elements of the system mentioned while still adhering to the same control process. For example, the position potentiometer could be replaced with a rotary shaft encoder, or the stepper motor controlled valve could be replaced with a solenoid valve, or the pressure transducer on the cylinder could be replaced with a load cell elsewhere in the mechanical system. These and other variations do not alter the control feedback process which is the subject of this description.

DETAILED DESCRIPTION OF THE INVENTION

A more detailed description of the invention will now be set forth with respect to a specific mechanical system, namely, an exercise apparatus.

Figure 1:
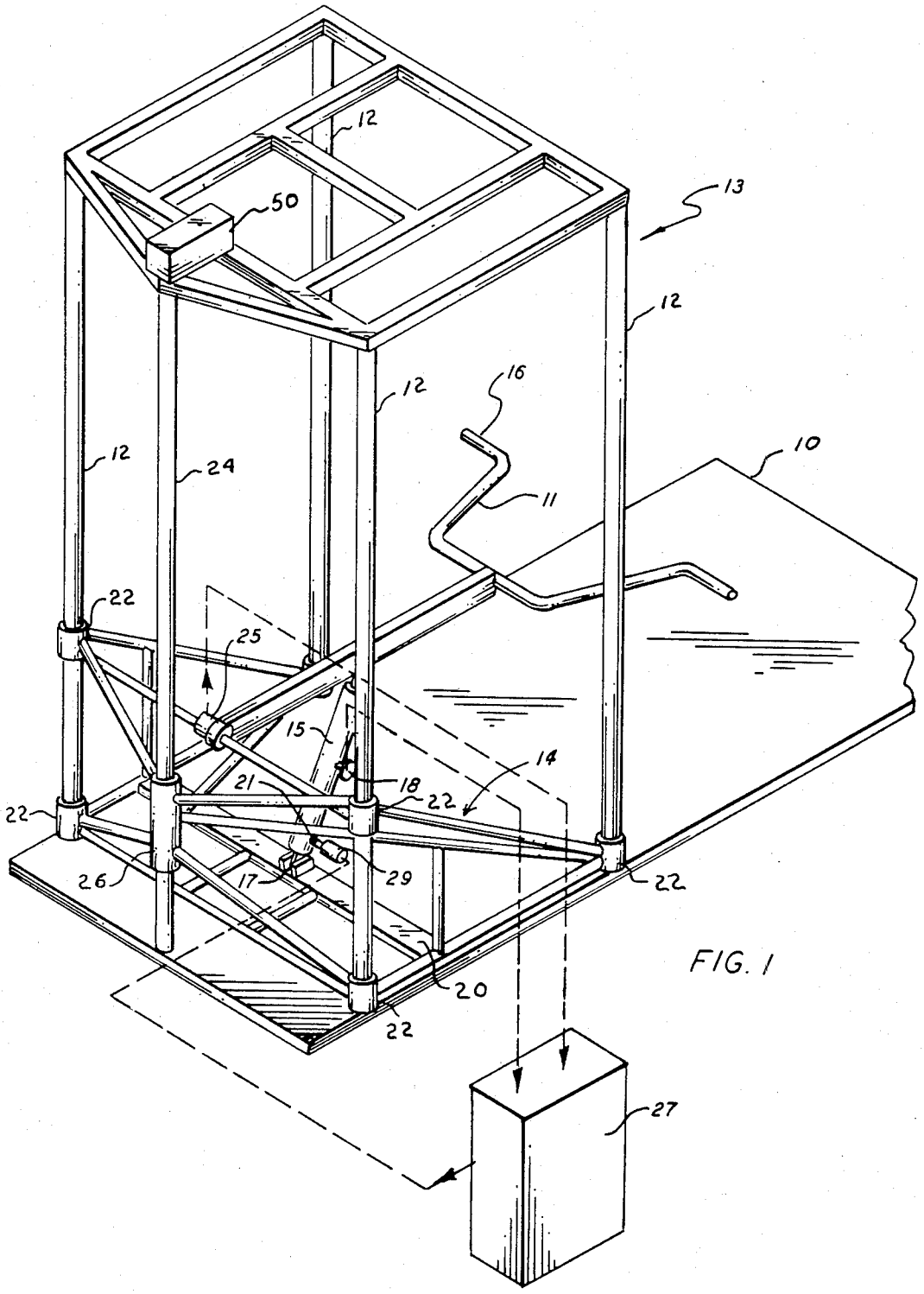
FIG. 1 is a perspective view of an exercise apparatus which includes a passive programmable resistance device constructed in accordance with the present invention.

Referring to FIG. 1, a set of movable handles 11, hereinafter sometimes referred to as an exercise bar, are rotatably disposed on a frame 13. The frame 13 has a fixed portion comprising four vertical shafts 12 secured to the base 10 and a movable portion 14 on which the exercise bar 11 is mounted. The exercise bar 11 supported on a base 10 has grips 16 by means of which a person doing exercises can grip the device to act against the force of a hydraulic cylinder and piston unit 15 which has its one end 17 rigidly secured to a strut 20 on movable frame 14 and its other end rigidly secured to the rotatable exercise bar 11. Movable frame is mounted to the shafts 12 using six oil impregnated bronze bearings 22. Up and down movement of frame portion 14 is by means of a threaded shaft 24 and threaded bearing 26. A drive motor 50 mounted to a support structure supporting shafts 12 and 24 drives shaft 24. This permits locating the exercise bar 11 for various exercises and adjusting it for the height of each individual. The amount of force which must be applied at the grips 16 is determined by the setting of a valve 21 in the cylinder. In prior art devices, such a valve was pre-set and the amount of force thereby determined. Any resetting of the force required a manual resetting of the valve. However, in accordance with the present invention, there is provided, coupled to the bar 11, preferably at its point of rotation about the shaft 23, an angle transducer 25 which provides an output representative of the angular position of the bar 11. Mounted on the cylinder 19 is a pressure transducer 18. Outputs from the angle transducer 25 and pressure transducer 18 are inputs to a computer 27 which in turn provides an output to drive means 29 for positioning the valve 21. In this manner, the computer can be preprogrammed to control the force which must be applied at the handles 15 is almost any manner desired. For example, the valve can be controlled to maintain a constant force, constant velocity, or constant acceleration. Similarly, it can be programmed for a variable force as a function of angle. Some of the various possibilities will become more evident from the discussion below.

Figure 2:
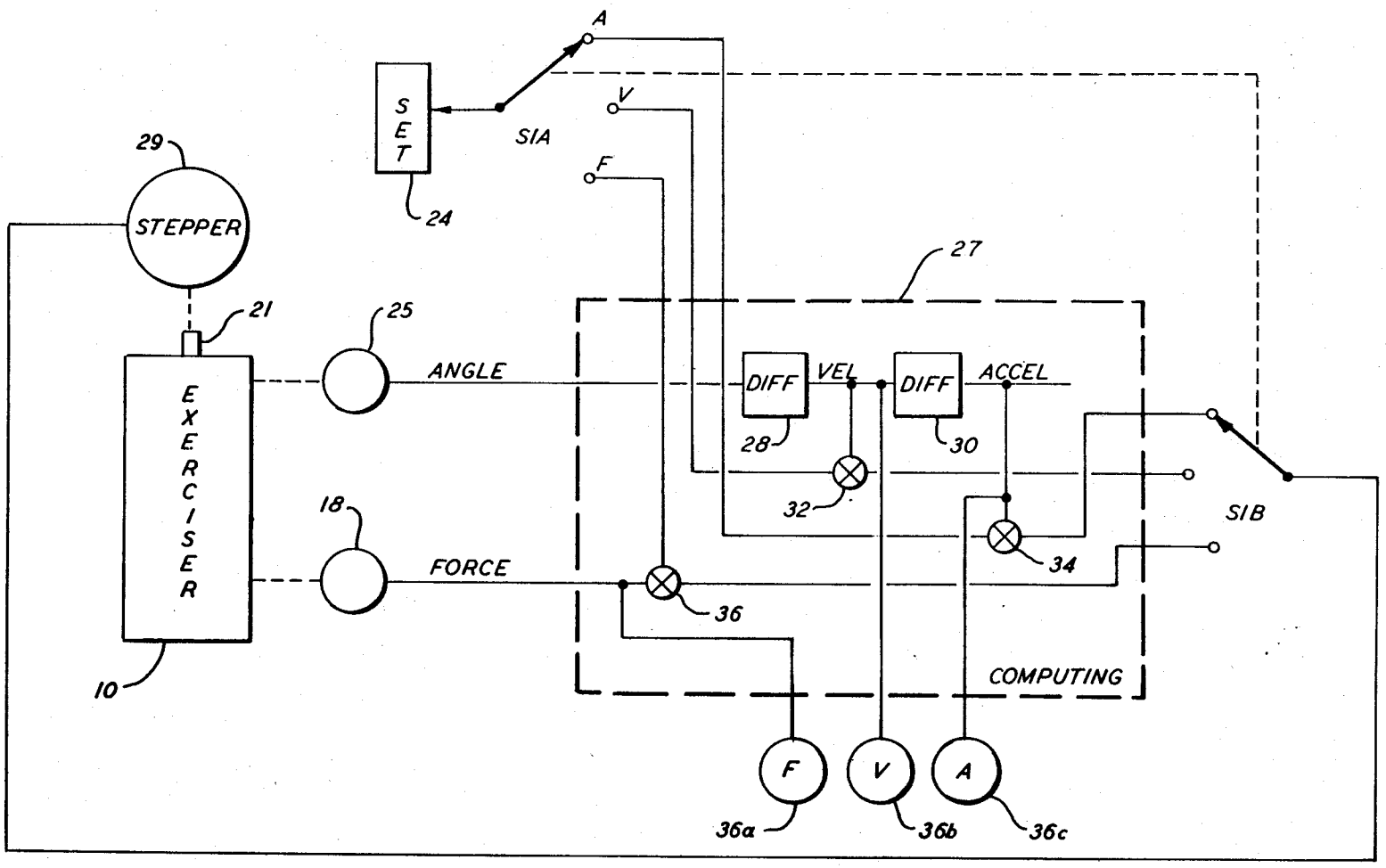
FIG. 2 is a block diagram of the exercise device implemented in analog fashion.

FIG. 2 illustrates a simplified form of the present invention. As indicated previously, there is coupled to the exerciser bar 11 an angle transducer 25 and a force transducer 18. The valve is controlled by a stepper motor 29; this could instead be a servo motor. Furthermore, although FIG. 1 illustrates hydraulic control, control utilizing various types of motors, particularly those with a friction drive is also possible. The angle transducer 25 may be, for example a potentiometer and the force transducer 18 a pressure transducer each of which provide an output voltage proportional to angle and force, respectively.

In the simple embodiment shown in FIG. 2, programming is carried out by means of a setting means 24 and a switch having sections S1A and S1B, at the input and output, respectively of the computing module 27. For example, the setting means may comprise a potentiometer. Shown are the possibilities of settings for an acceleration, velocity or a force, whichever is desired. The angle input to the computing means 27 is differentiated once in a differentiator 28 to obtain a velocity signal and then differentiated again in a differentiator 30 to obtain an acceleration signal. The input labelled A, for acceleration, is compared or summed with the acceleration signal at a summing junction 34. Similarly, the input V is summed at a summing junction 32 with the actual detected velocity and the input F summed with the force input in a summing junction 36. The results of this are fed out through the switch section S1B as an input to the stepper motor 29. The stepper motor 29 will naturally have means associated therewith to convert a voltage signal into a stepper motor position. Alternatively, as noted above, the stepper motor can be replaced by a linear servo system. With this arrangement, which would preferably also include amplifiers and possibly some function generators to take care of nonlinearities, the motor 29 is controlled in a manner so that the actual acceleration, velocity or force equals the desired acceleration velocity or force as set in at the setting means 24. Feedback to the user can be provided by meters 36*a, b* and *c* coupled to the force, velocity and acceleration signals respectively to give him instant feedback so that he can determine whether or not he is meeting the requirements he set for himself at the setting means 24.

Naturally, this system only gives the capability of providing constant force, velocity or acceleration. However, it can be expanded in such manner that it is possible to set in a velocity, force or acceleration profile. Naturally, such will require additional components. For example, a plurality of programming resistors, providing different voltages along with appropriate switching means operated as a function of angle can be used. However, in order to get the desired flexibility and to be able to provide operation both with constant input parameters and variable parameters, it has been found that computing means in the form of a microprocessor are preferable. Such gives almost unlimited flexibility both with respect to the types of exercise profiles which can be programmed and with the ability to provide information to the user and, for that matter, to others who may wish to monitor him, along with providing the ability to make a permanent record of his performance for further analysis. Such a system is illustrated in block diagram form by FIG. 3.

Figure 3:
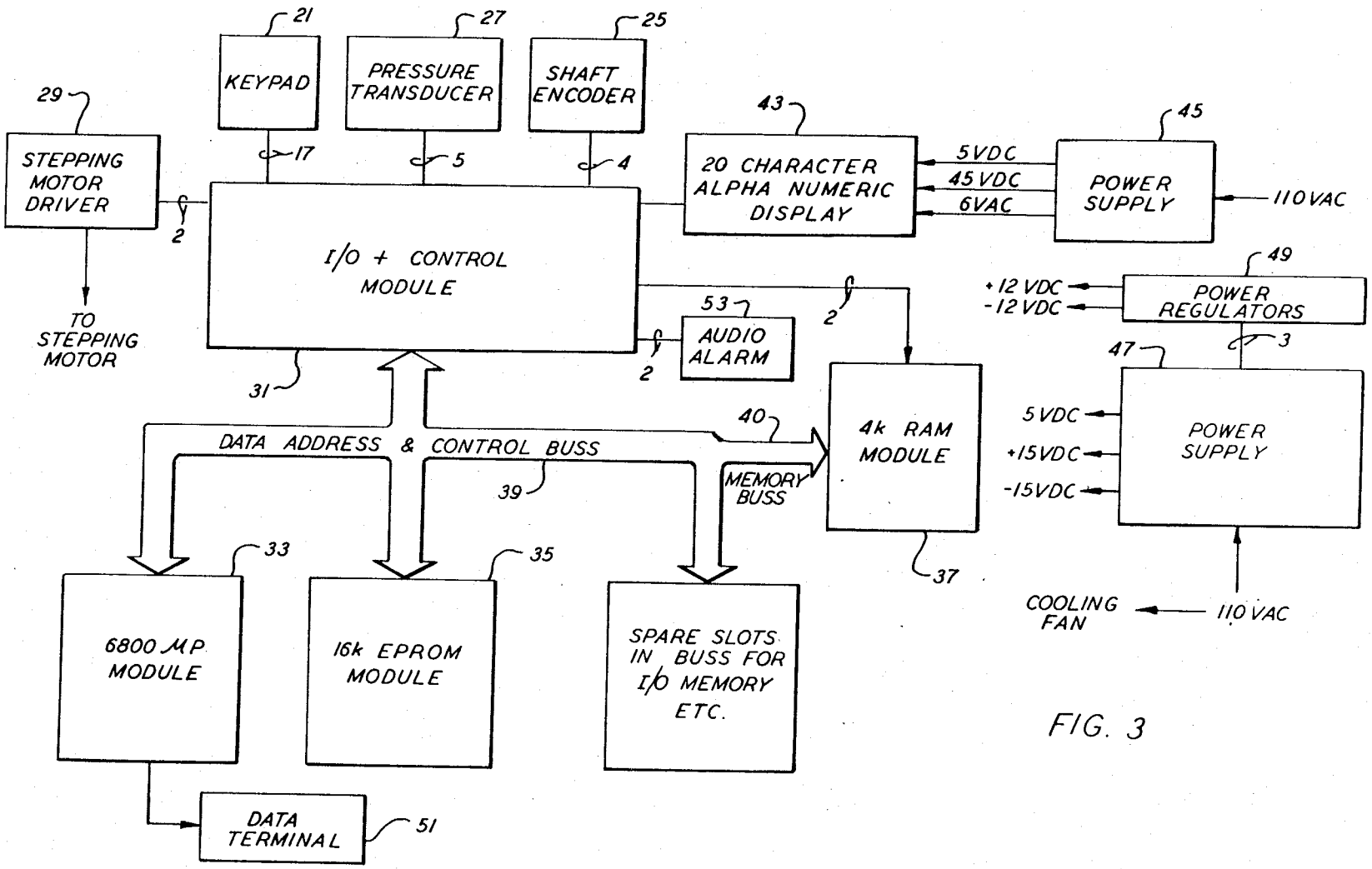
FIG. 3 is a block diagram of the system for controlling resistance implemented utilizing a microcomputer.

FIG. 3 is a block diagram of one system constructed according to the present invention. The computer comprises a microcomputer which includes an I/O and control module 31, a microprocessor module 33, a read-only memory 35, and a random access memory 37, interconnected by means of a common data, address and control bus 39 with the memory connected to a memory bus 40 having some lines in common with bus 39. The I/O and control module 31 receives inputs from the pressure transducer 18, the angle transducer 25, for example, a shaft encoder and provides outputs to the drive 29, for example, a stepping motor. The system also receives inputs from a key pad 41 which permits the user to set in the type of exercise he desires and provides outputs to an alpha-numeric display 43 to aid in the interaction of the user with the computer. Power supplies 45 and 47 are provided, along with a power regulator 49 coupled to the output of power supply 47 to supply the various voltages needed in the system. Although, various elements can be used, it has been found that a pressure transducer model AB from Data Instruments, Inc. works well as pressure transducer 18. Similarly, the shaft encoder may be one made by Theta Instruments under the part No. 05-360-1 which outputs 360 pulses per revolution. Because the nature of the exercise bar 11 is such that the hydraulic cylinder will allow it to go to its lowest position when it is released, on start up, the computer can determine that the device is in the initial position, and thus the only information required from the shaft encoder are pulses indicating an angular change. This information can then be counted or integrated within the computer to keep track of the exact angle. The particular stepping motor used is one available from Superior Electric which comes equipped with a translator for converting 12 volt pulses into proper drive signals for the motor. This type of device operates by receiving counter-clockwise and clockwise pulses as required with the translator converting the pulses into position signals.

Also shown on FIG. 3 is a data terminal 51 which can be plugged into the micro-processor module 33 to permit printouts and plotting of information. The particular microprocessor used in a Motorola 6800 $\mu$P one processor board obtained from Wintek Corporation. The read-only memory used is an E-Prom 16 K module also from Wintek. The random access memory is a 4K RAM module obtained from Atwood Enterprises and the I/O control module one of special design to be discussed in detail below. The key pad 41 is a 16-key key pad available from Cherry. Also provided is an audio alarm 53 manufactured by Mallory. This is what is sold by Mallory as Sonalert, and is used for attracting the user's attention. It should be noted, that although specific microcomputer components from various manufacturers have been used herein, that other microcomputer components can equally well be utilized.

FIGS. 4*a, b* and *c* illustrate the various signals which are carried on the data, address and control bus. FIGS. 4–6 are explained in detail in the aforesaid U.S. patent application Ser. No. 949,237, and this description is incorporated herein by reference. FIG. 5 illustrates the I/O module 31 along with some of the modules with which it communicates.

The output of the pressure transducer is provided as an input to an analog to digital converter 107 which converts the analog signal from the pressure transducer to a digital output. The analog to digital converter 107 also supplies the necessary voltages to the pressure transducer. Analog to digital converter 107 provides 10 data lines of output. It also accepts a start signal which starts a conversion, a certain period of time after which the result is available at the output. In the present system, the timing for the conversion is done in the computer so that a pre-determined period of time, e.g., 6 milliseconds, after a start signal is given, data is read out. The data from analog to digital convertor 107 is an input to a peripheral interface adaptor 109. Also, communicating with this port is the key pad 41. The key-pad has 16 keys which simply make a closure between a common and a given line, with the common connected to ground. The 16 outputs of the key pad are coupled into two priority encoders 111 and 113. The encoders need not have the priority feature, but in the present case these were the most convenient to use. Each of the priority encoders converts 8 inputs into a 3-bit code. The outputs of the two encoders 111 and 113 are cascaded in NOR Gates 115 through 118. The result of this conversion is a four-bit code, the outputs of which are designated K0, K1, K2 and K3. These are inputs to the input/output port 109. The output of gate 115 is used to simply indicate that a key has been pressed.

The shaft encoder provides outputs on two lines, the outputs being 90° out of phase with each other. These outputs are inputs to comparators 119 and 121. The shaft encoders produce a signal which is roughly a sine wave with a minimum of about 50 millivolts and a maximum of about 150 millivolts. Comparators 119 and 121 shape the sine wave into square waves with the proper voltages and polarities. The output of each of the comparators 119 and 121 is coupled through a buffer 123 or 125 respectively. The output of the buffer 123 is coupled into a one-shot multi-vibrator 127 which responds to a positive going pulse and the output of the buffer 125 into a one-shot multi-vibrator 129 which responds to a negative going pulse. The output or buffer 125 is also provided as one input to an AND gate 131 and as one input to an AND gate 133, at the inputs of one-shot multi-vibrators 135 and 137 respectively. The second input of gate 133 is the output of the one-shot 127 and the second input of Gate 131 the output of the one-shot 129. One-shots 127 and 129 give a 1 micro-second wide pulse. This in effect decodes the outputs of the shaft encoder so that an output will appear from one-shot 135 for a clockwise pulse and out of one-shot 137 for a counterclockwise pulse. The two signals are Ored in a gate 139 to provide an output which indicates simply that an encoder pulse has occurred.

Figure 5B:
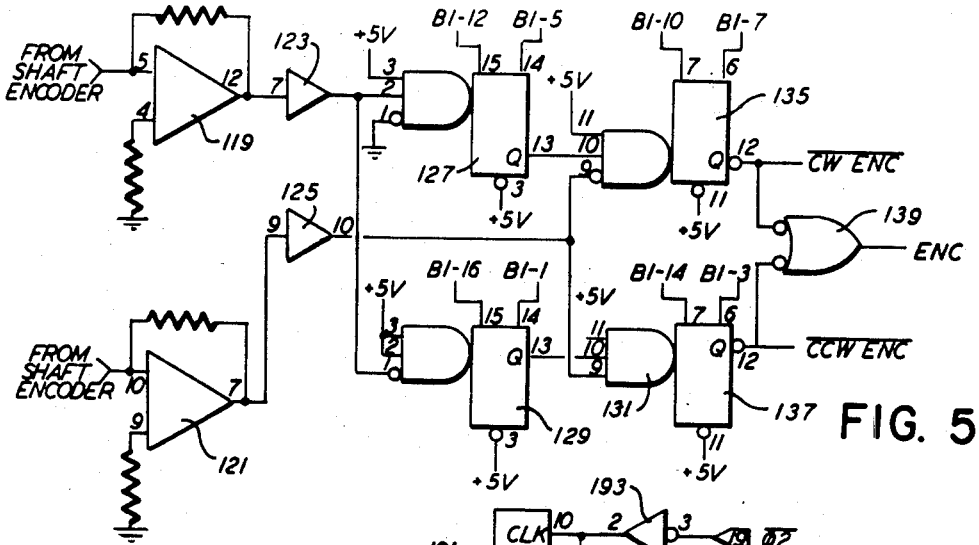
FIGS. 5A, 5B, 5C, 5D, and a block-logic diagram of the I/O and control module of FIG. 3.
Figure 5A:
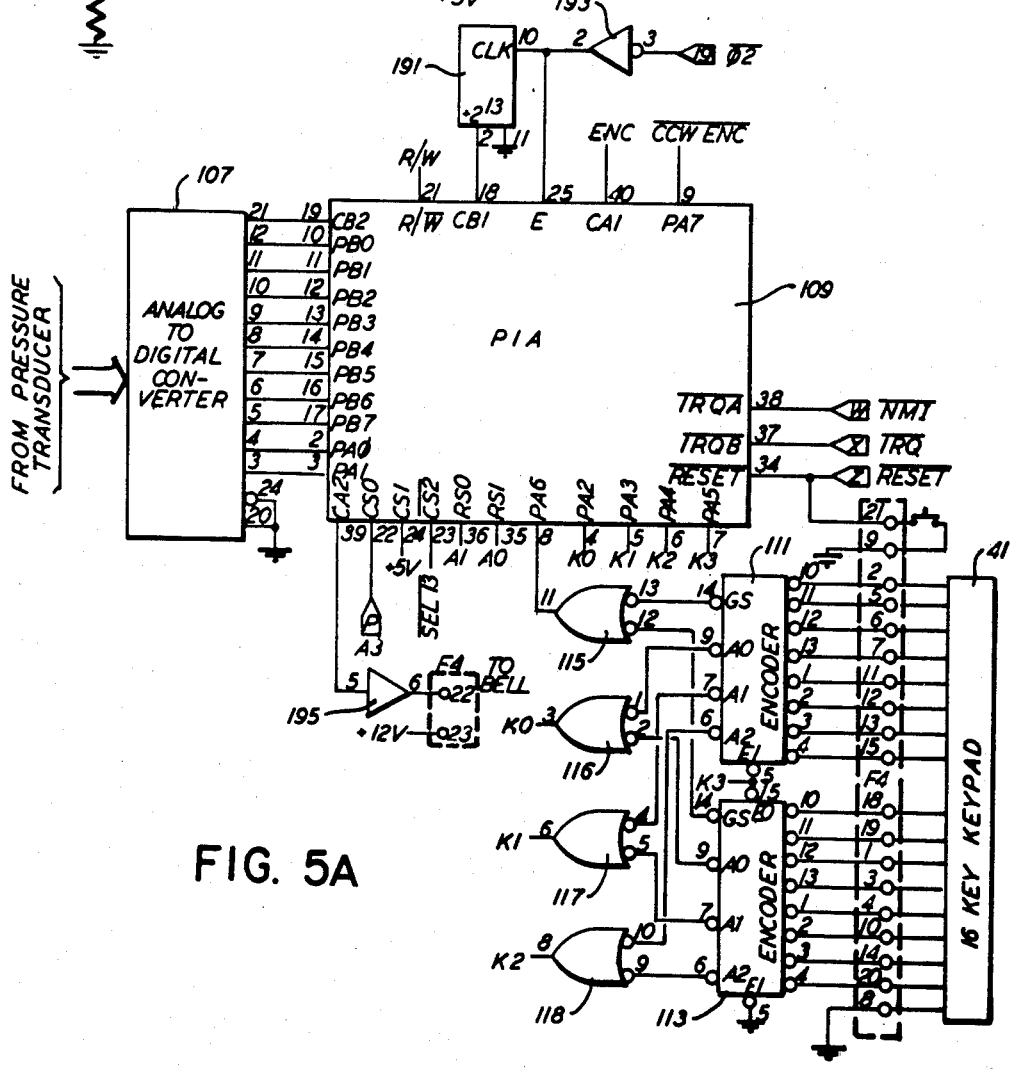
Figure 5C:
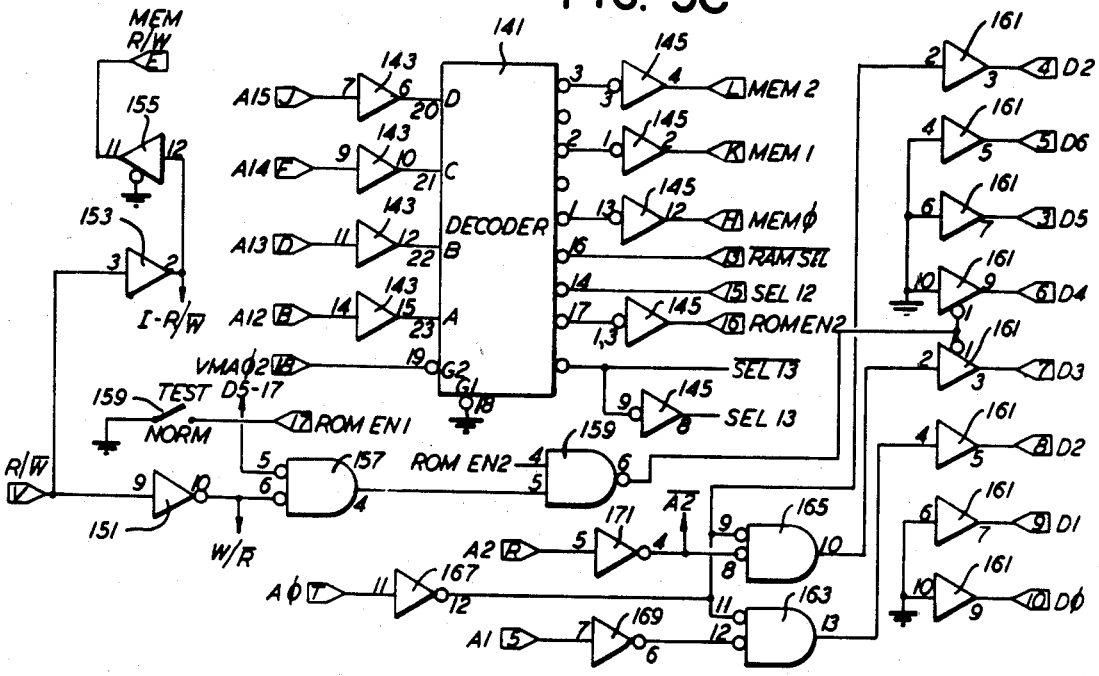
Figure 5D:
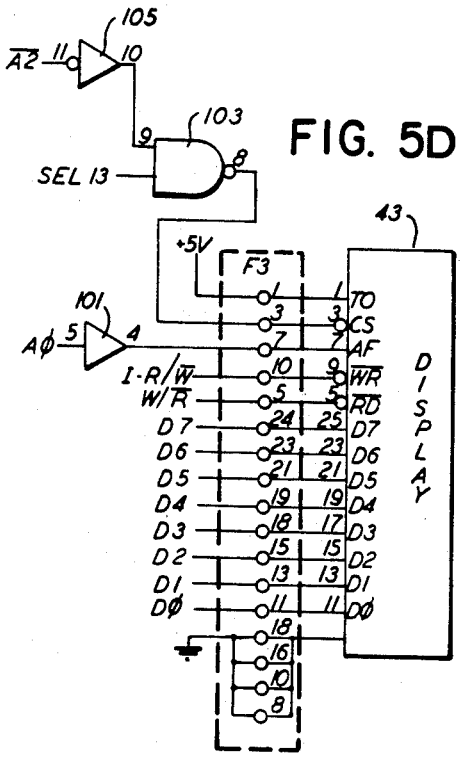
Figure 5E:
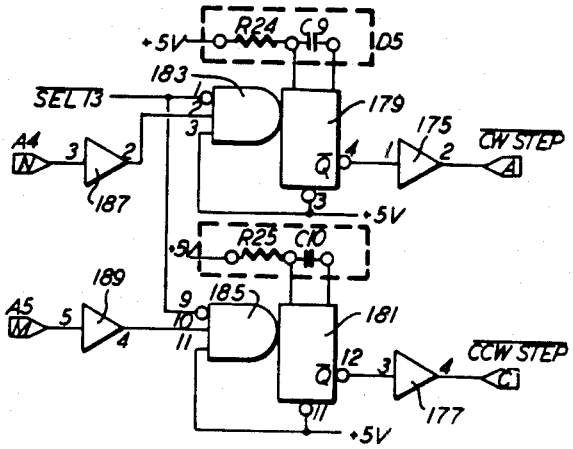
Figure 6:
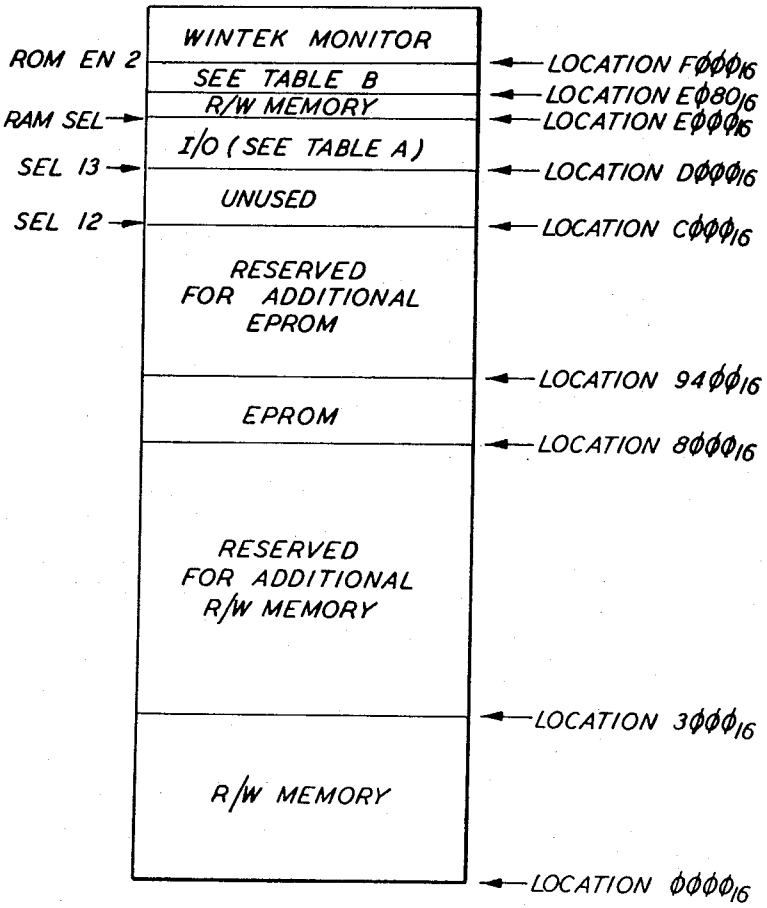
FIG. 6 is a diagram illustrating memoray assignments.

In the lower right-hand corner of FIG. 5E is the circuitry for driving the stepper motor. The stepper motor receives output from buffers 175 for a clockwise step and 177 for a counterclockwise step. The signals being output are the inverted signals. These signals are obtained from one shot multi-vibrators 179 and 181, respectively. The inputs to the multi-vibrators are through AND gates 183 and 185, respectively. Each of the AND gates has an inverted input which receives as an enabling input signal the signal $\overline{\text{SEL13}}$.

With reference to the FIG. 4, it can be seen that $\overline{\text{SEL13}}$ is used to select input/output and that the addresses assigned to the clockwise and counterclockwise outputs are D010 and D020. This corresponds to the address bits A4 and A5. Thus, the address bit A4 is coupled through a buffer 187 as a second input to the gate 183 and A5 through a buffer 189 as a second input to gate 185. The one shots are adapted to generate a 200 microsecond pulse which is the input to the translator associated with the stepper motor.

From FIG. 5 it can be seen that the signal SEL13 is used to select the I/O. Going then to Table A, it is seen that the addresses D008–D00B are assigned to PIAO. DIAO is the adaptor 109. This system has the capability of accepted additional PIAs which are not presently installed.

The remainder of the system, i.e., the microprocessor, which basically uses Motorola components, along with the memories, are connected in conventional fashion.

Figure 8:
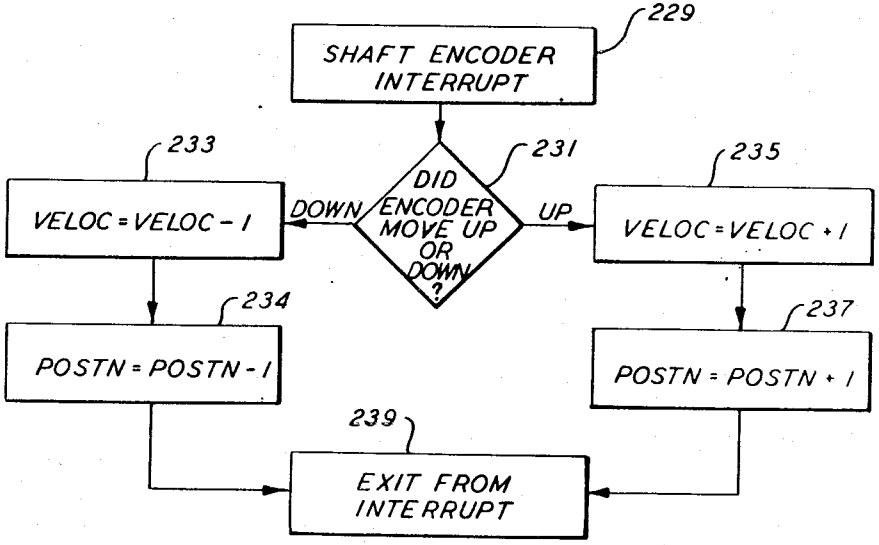
FIG. 8 is a flow diagram showing position and velocity monitoring in response to a shaft encoder interrupt.
Figure 7:
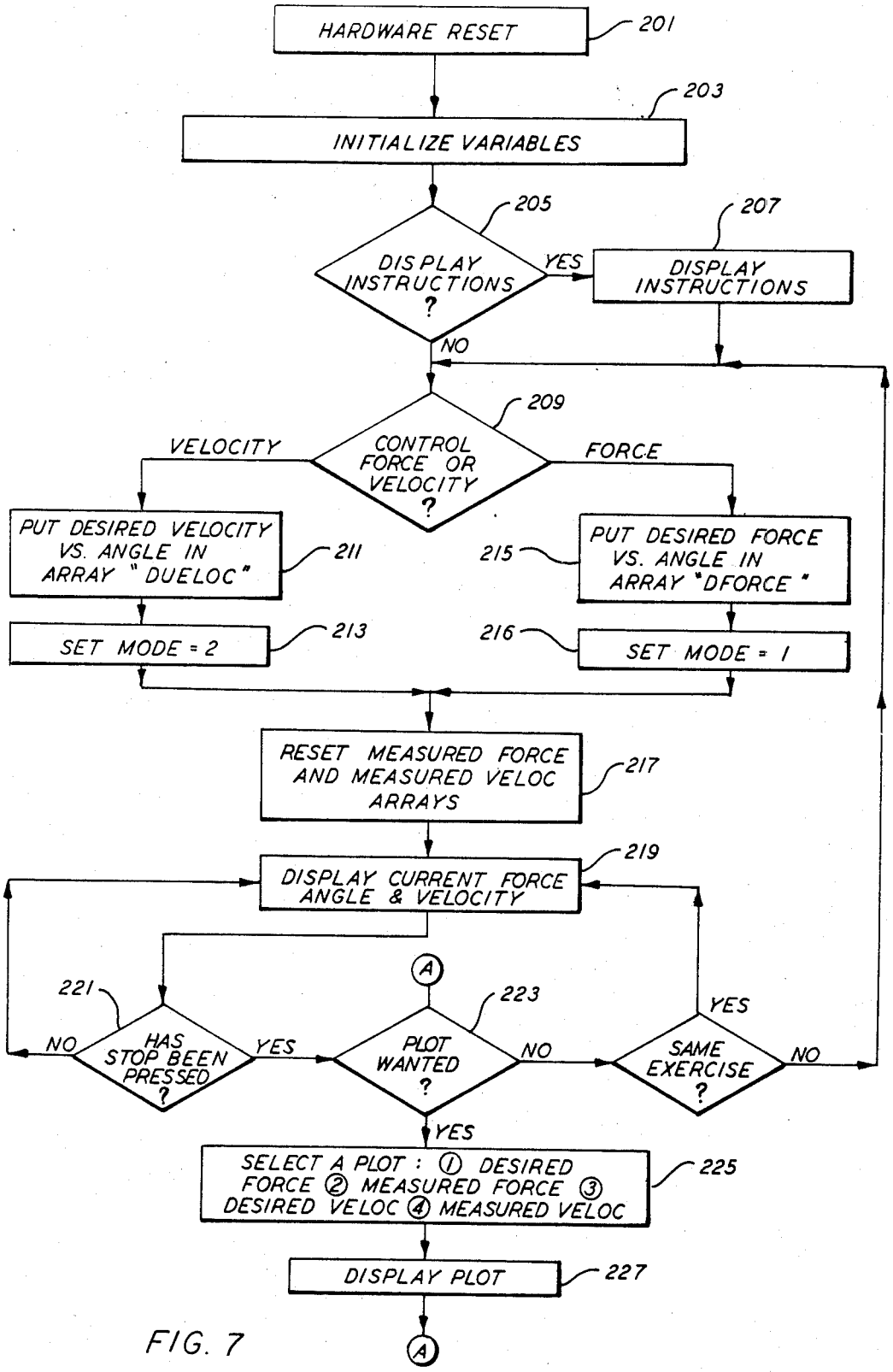
FIG. 7 is a flow diagram of the main program used in the microprocessor of FIG. 3.
Figures 9, 9B:
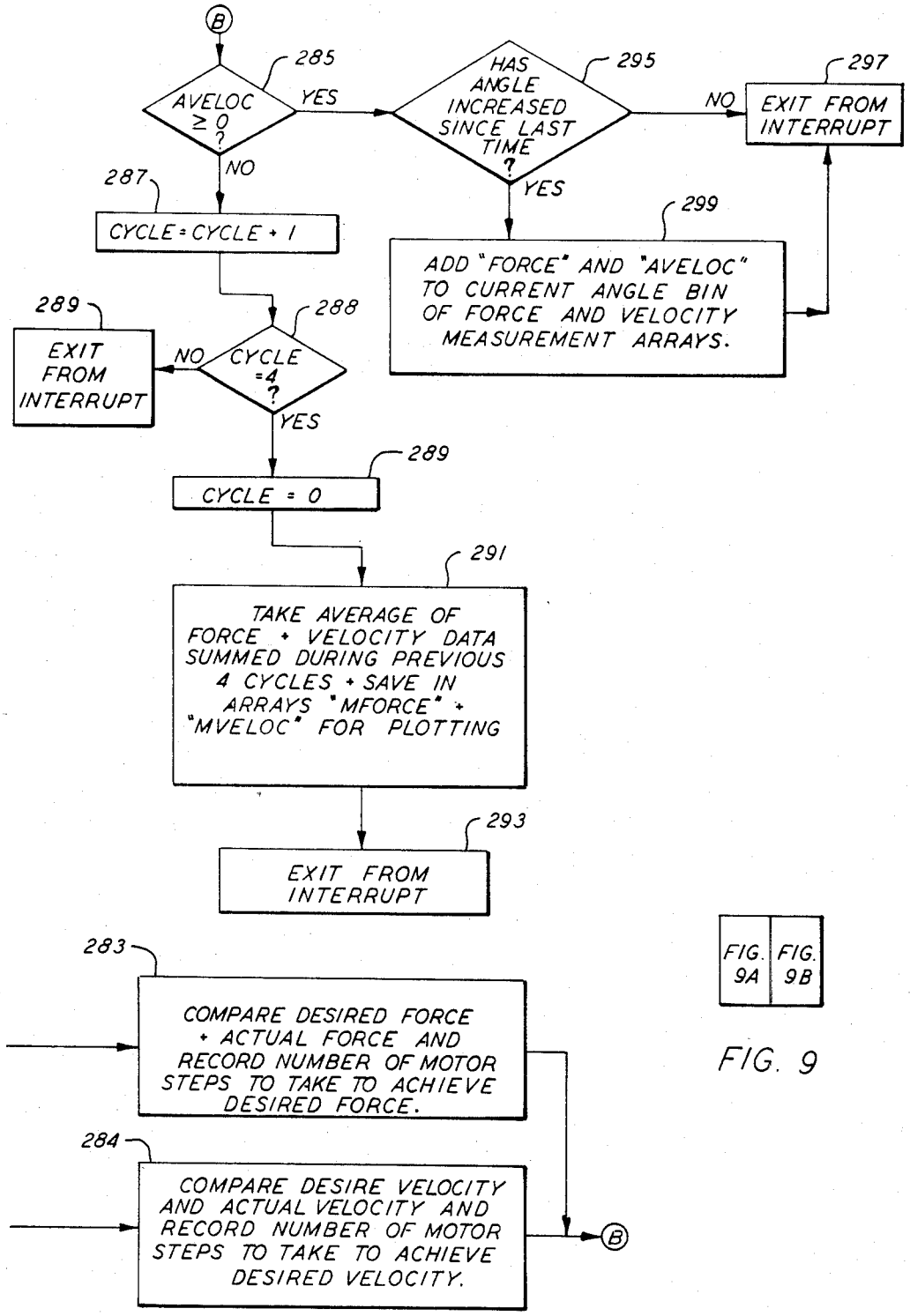
FIGS. 9, 9A, and 9B are a flow diagram showing the response of the computer program to a clock interrupt.
Figure 9A:
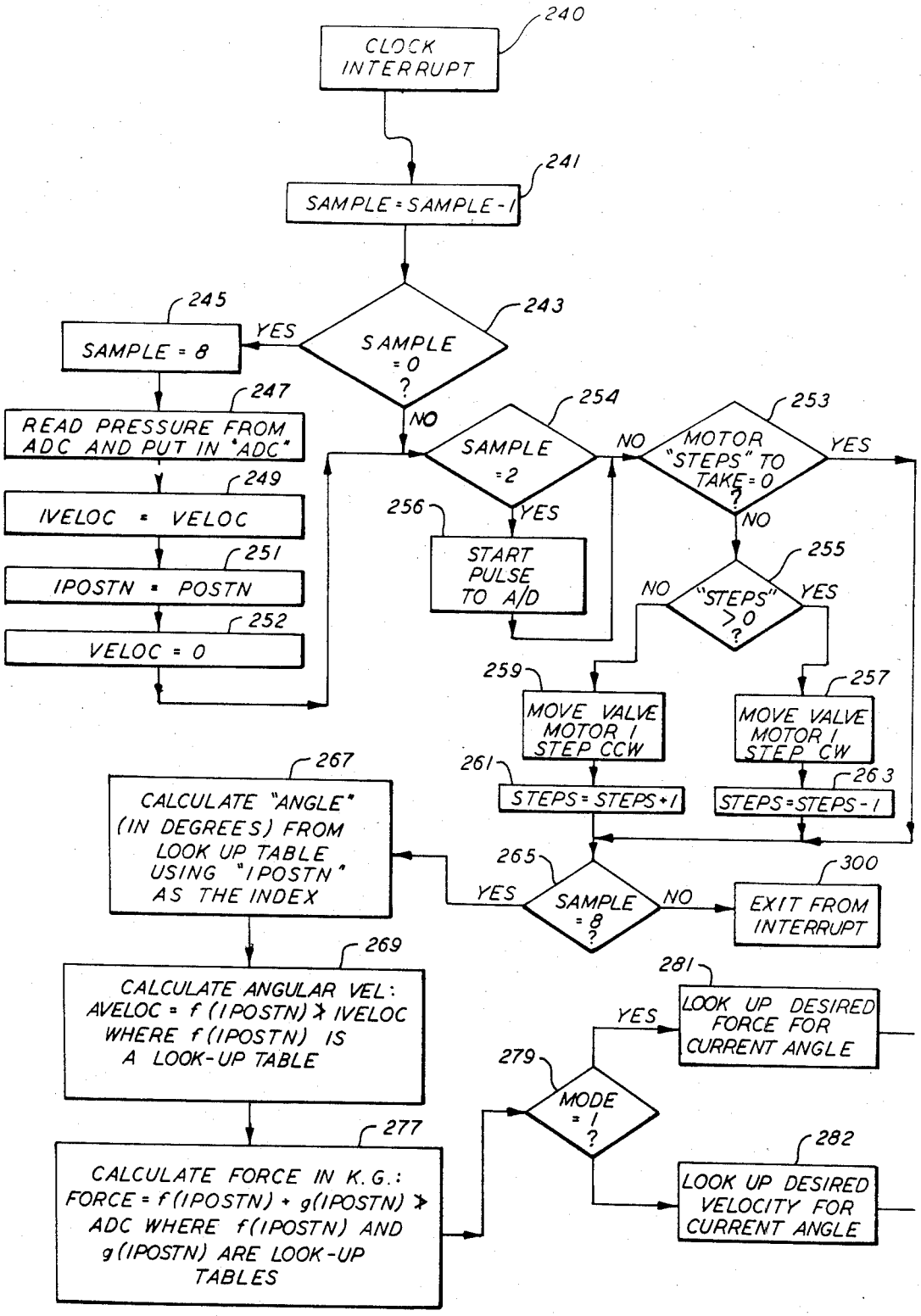

The manner in which the system operates can best be understood with reference to the flow charts of FIGS. 7–9.

Operation is started in the main program shown on FIG. 7 by pressing a hardware reset button as indicated in block 201. This pulls the reset line low, causing the restart address to be generated. It is assumed that the test/normal switch 159 of FIG. 3 is in the normal position. The first thing done is to initialize the variables as indicated by block 203. The program then enters a decision block 205 which asks if instructions should be displayed. This question is put on the alphanumeric display and asked to the user. If the user answers "yes", a block 207 is entered and instructions are displayed. This is done on the 20 character display and is scrolled using conventional techniques. The keyboard includes keys labelled 0 through 9, yes, no, enter, rub out, start and stop. If in response to the question "display instructions?", the user wanted instructions, he would hit "yes" and as indicated by block 207, the instructions would be displayed. The attached program and the flow chart of FIG. 7 are set up to permit controlling force or velocity. It should be noted that the system can also be programmed to control other parameters such as distance and acceleration. Once the instructions are displayed, which instructions give the user general information about the machine, or if the user, being familiar with the machine did not ask for instructions to be displayed, a decision block 209 is entered. Here the user is asked whether he wishes to control force or velocity. In addition, the program will ask information concerning what velocity and what force is desired. The attached program is set up to handle a constant force, constant velocity or a variable force and variable velocity in which the beginning value and ending value are specified. Reference to the program will show the exact questions that are asked. Specifically, the exercises just mentioned are given numbers so that the user is asked "Exercise number?", he can select Exercise 1, 2, 3 or 4. If he selects the exercise where he specifies initial force and final force, then those questions will be asked. Otherwise, if he selects constant force, he will only be asked for one number. Similarly, he can select a single velocity or initial and final velocity.

Continuing with the flow diagram of FIG. 7, if velocity is selected then, in accordance with block 211, there is stored in memory an array of desired velocity versus angle. Thereafter, in block 213 the mode is set equal to 2 indicating velocity mode. Similarly, if force is selected, in accordance with block 215, an array of desired force verses angle is stored and the mode is set to 1 in accordance with block 216. Included within the system are also measured force and measured velocity arrays. In accordance with the next block 217, these are zeroed or reset. At this point, instructions are given to the user that he may start the exercise; the specific instructions are set out in the program. During exercising, current force, angle and velocity are displayed as indicated by block 219.

After exiting this block, the program goes into a decision block 221 which asks if stop has been pressed. The exerciser has been told to press stop when he is finished. If he does not press stop, the program keeps looping back through block 219. Once stop has been pressed, a decision block 223 is entered, at which point the user is asked if he wants a plot. As noted above, the system can interface with any standard terminal. If a plot is selected, the answer is yes and the block 225 is entered. Here the user is given the choice of selecting a plot of desired force, measured force, desired velocity or measured velocity. This block is exited and the plot is displayed as indicated by block 227. The program exits from there back to the decision block 223 to see whether another plot is desired. When it is desired to do another exercise, hardware reset is pressed in accordance with block 201 and the program is gone through again. It should be noted that although the present program is set up to handle constant forces and velocity or linearly changing forces and velocities, the capability is present to construct an arbitrary force or velocity curve. Similarly, other programs which provide constant or variable acceleration or which control the ranges of movement are also possible. For example, to generate a velocity which is variable with angle, it would only be necessary to input into each of the locations of the desired velocity array, a velocity desired at that angle. As presently set up, there are 120 locations in the array, each representing a half-degree in position, giving a range of roughly 60°. The information used for the plot of measured force and measured velocity is obtained from the measured force and measured velocity arrays which have a value recorded therein every half-degree. The program is presently set up so that four cycles of the exerciser are averages for plotting purposes. Thus, normally after setting in the desired parameters, the person doing the exercise will go through the exercise four times before asking for a plot. A single cycle is not used because cycles can vary quite a bit from one to the other and it is felt that average values are better. Another possibility is loading into the desired velocity or desired force curve what has been measured in the measured force or measured velocity curve.

For example, if an athlete is trying to develop a certain type of motion for a certain sport, someone who is an expert in that sport can perform that movement on the exercising machine. His movement can then be stored and a trainee can then be asked to operate the machine using that stored information. This would then permit him to maximize the development of his muscles to obtain a velocity profile which would be most helpful in that particular sport. Other possibilities include additional programs to examine the measured velocity and force curves after each four exercises to determine whether or not the exerciser is tiring and to automatically decrease the severity of the exercise in accordance therewith. This permits exercising until completely fatigued. For example, if the exerciser initially set in a 50 pound force and after four cycles his velocity had slowed down considerably, the program could automatically reduce the force to 40 pounds and so on, permitting the exerciser to work against less and less force as he tired to get the maximum benefit from exercising. In contrast thereto, with present systems, for example, with weights, it would be necessary to change the weights in order to do this.

As noted above, during the exercising the measured force and velocity is displayed along with the current angle. This gives immediate and positive feedback to the user and permits him to know immediately whether he is maintaining the force which he has set in for himself.

One important aspect of the system of the present invention is that it is impossible to have a force harder than the exerciser is pushing. The way the unit operates is that if the user is exerting, for example five pounds and he should be exerting twenty pounds, the hydraulic valve is closed down so that the user cannot use the bar unless he exerts the twenty pound force. However, he can always leave the bar still. The system insures as nearly as possible that the desired force is not exceeded. In this way, it becomes impossible to destroy the machine by exerting excess force. The only limitations on these controls are in the response time of the stepper motor which controls the hydraulic valve.

FIG. 8 illustrates the operation of the shaft Encoder interrupt. As indicated by block 229 the first thing to happen is that an interrupt occurs. A decision is then made in the decision block 231 whether the Encoder moved up or down. Depending on the answer to this question, the program either enters a block 233, where the velocity is decremented by 1, whereafter it enters a block 234 where the position is decremented by 1 or it enters a block 235 where the velocity is incremented by 1 or a block 237 where the position in incremented from 1. After leaving block 234 or 237, it exits from the interrupt as indicated by block 239. This interrupt is serviced whenever it occurs so that, wherever the main program is, it stops, services the interrupt and then returns to the main programming. What occurs in blocks 233, 234 and 235 and 237 is simply the incrementing or decrementing of a counter. This is done to minimize the time spent in the interrupt. From this information and other information stored in the computer, such as time, the necessary calculations can then be carried out. As previously indicated, the shaft encoder only indicates the change in position. Thus, if the position becomes negative, it becomes known that the exerciser did not start at a zero position and the position is automatically set to zero. Position can be determined directly from the counter since it is known that each increment of position equals a certain amount of travel. Velocity, however, cannot. In order to measure velocity, the velocity counter is reset after a predetermined number of clock pulses and the value, before reset, saved, as the velocity over the interval. Thus, since the interval is about 1/15 of a second, it counts pulses for that time then stores the result and resets the counter.

The clock interrupt routine is illustrated on FIG. 9. In response to a clock interrupt 240, which is noted above, occurs about 15 times a second, a sample counter is decremented as indicated by block 241. A decision block 243 is then entered where a check is made to see if the sample is zero. If the sample is zero, in a block 245, the sample count is set to 8. Then, the pressure is read from the converter and loaded in an appropriate location as indicated by block 247. The instantaneous velocity is set equal to the quantity "velocity," the quantity which was indicated on FIG. 8, as indicated by block 249, i.e., this is the velocity which has been summed or integrated over the 8 samples. The position is updated to the current position as indicated in block 251, and velocity is then set to zero as indicated by block 252. The quantities IVELOC and IPOSTN are thus obtained. Either after exiting block 255, or if the sample number is not zero, a decision block 254 is entered. This block checks for sample equal to 2. If the answer is yes, block 250 is entered and the start pulse is sent to the analog to digital converter. From block 254 or block 256 the program enters decision block 253. This block determines how many steps there are for the motor to take. Since the motor cannot respond instantaneously, the motor is only moved one step per interrupt. If there are steps to take, the answer is no, and a decision block 255 is entered where a check is made to see if the number of steps is greater than zero. This in effect tells whether the steps must be clockwise or counterclockwise. If the steps are greater than zero and as indicated by block 257, the valve motor is moved one step clockwise. Otherwise as indicated by block 259, it is moved one step counterclockwise. After exiting these blocks the quantity "steps" is updated as indicated by blocks 261 and 263. In other words it is either incremented or decremented by one.

After exiting this portion of the program, a decision block 265 is entered where a check is made to see if the sample number is 8 indicating that this is the first pass through the program after resetting the sample number. If the answer is yes, the angle in degrees is calculated from a look-up table using "IPOSTN" as the index, as indicated in block 267. Then, angular velocity is calculated in accordance with block 269. Next, force in kilograms is calculated as indicated in block 271. Then, a decision block 279 is entered where a check is made to see what mode the system is in, i.e., mode one or mode two, a force mode or a velocity mode. If the mode is one, then the program looks up the desired force as indicated by block 281. If not mode one, i.e., mode, then block 282 is entered and the desired velocity is looked up for the current angle. Blocks 281 and 282 lead respectively to blocks 283 and 284 in which a comparison is made between the actual value and the desired value, and a number of motor steps necessary to reach the desired value calculated.

The program then goes to a decision block 285 where it determines whether the quantity AVELOC is equal to or greater than zero. This value is the calculated average velocity obtained in block 269. If the velocity is not greater than or equal to zero the answer is no, and the cycle is set equal to the previous cycle plus 1, as indicated by block 287. Next, a check is made to see if the cycle is equal to 4 in dicision block 288. If it is not, then the interrupt is exited as indicated by block 289. If the answer is yes, the cycle is reset to zero as indicated by block 289, and thereafter the force and velocity of the four previous cycles is average as shown by block 291, whereafter the interrupt is existed as indicated by block 293. This is the averaging which is done by for plotting purposes.

If the velocity is not greater than or equal to zero, the question is asked whether the angle has increased since the last time in block to 95. If the answer is "no", the interrupt is existed as indicated by block to 297. If the answer is "yes", force and AVWLOC are added to the current force and velocity measurements as indicated by block 299 and again, the interrput is exited. Returning back to decision block 265, if the sample is equal to 8 than an immediate exit occurs as indicated by block 300.

Examination of the flow chart will show that the pressure is read in every 8 samples, and that calculations are done every 8 sample times, except the averaging calculation which are done every 4 cycles. The only operation which is carried out every interrupt is that of stepping the motor, if necessary. Again, it is pointed out that such is required since the motor cannot respond quickly enough. Thus, the calculations in blocks 283 or 284 may require, for example, three or four steps of the motor. These will take place over the next three or four sampling intervals even though nothing else is being done.

In blocks 267, 269 and 277 it should be noted that calculations are done to determine velocity and to determine force. The calculation is done utilizing functions of position F[IPOSTN]G[IPOSTN]. In the embodiment of the exerciser for which the present program was design, the shaft encoded is not connected directly at the fulcrum but is coupled through a timing chain. This means that it does not accurately represent angle. A calculation was made of the relationship between angle at the shaft encoder and angle at the point of rotation and utilized to construct a first look-up table. Similarly, there is another table which correlates encoder pulses to degrees. In this particular instance, one encoder pulse equals one half degree. These two calculations permit the use of the system of the present invention with any exerciser. In other words, these tables can be matched to any exercise machine taking into account its range of movement and any non-linearities between the shafting encoder output and movement of the machine. Furthermore, since the machine operates with a piston which is attached to the lever at some point other than the end where the force is applied by the user, there is a certain function involved between the pressure read out at the hydraulic cylinder and the pressure applied at the handles. This is the function G which contains a normalizing factor to convert the output of the pressure transducer into kilograms. The function G also corrects for varying angle between the exercise bar and the cylinder. It also takes into account the lever arm and the cylinder area when converting pressure to force at the exercise bar. Finally, there is a table, giving the function F which takes into account the weight of the exercise bar. The weight which the user experiences will depend on the angle of the exercise bar, i.e., when it is horizontal, the weight will be maximum, and when vertical, minimum. The function F takes this into account again in a look-up table.

Furthermore, note that the function of the decision block 285 is to either update the bin in the arrays for current measurements or to initiate the averaging which occurs at the end of the cycle. If the velocity is less than zero, it means that the bar is moving down and thus the cycle is over.

It should be noted that although plotting has been given as an example of how the data is taken out of the system, other possibilities exist. It is also possible to couple a record, e.g., a tape recorder or a disc recorder, to the computer and record a person's performance at an exercise session. This recorded information can then be used for analysis purposes and can furthermore be used to read back into the machine to ensure that he continues to increase the difficulty of his exercise from day to day.

A plurality of devices in accordance with the present invention can also be connected to a central computer under the control of an instructor who could immediately analyze incoming data which was transmitted from the exercise machines to the main computer. Furthermore, with such a tape or disc recorder pre-programed exercises can be provided. Previously, an example was given where a skilled athlete recorded a certain profile which was stored in current arrays and then transferred to the desired array. Similarly, such data, either from actual measurements on experienced athletes or through calculation can be recorded on a disc and the disc used as input to the system of the present invention. Similarly, the capability of exercising in accordance with previous data or stored data has great application in the area of rehabilitation where the force that can be applied in acertain ranges of movement is limited.

I claim:

1. A programmable resistance device comprising;

(a) a hydraulic cylinder;

(b) a piston mounted in said cylinder for movement by a force applied to the piston;

(c) a control valve for controlling the flow of hydraulic fluid from said cylinder as said piston moves and thereby controlling the amount of resistance provided to movement of the piston;

(d) means for measuring the pressure in said cylinder to provide a first output which is a function of force applied to said piston;

(e) means for providing a second output which is a function of the position of the piston;

(f) drive means for controlling said valve; and (g) programmable means having as inputs said first and second outputs and providing a third output coupled as a control input to said drive means, said programmable means including means to store an array of desired force values versus position; means responsive to said second output to select one of the stored values of force for comparison; and means to compare said selected value with said first output and to provide said third output in accordance with the difference therebetween.

2. The device of claim 1 where said drive means comprises a stepper motor.

3. The device of claim 1 wherein said drive means comprises a stepper motor which rotates in response to said control input to increase or decrease the rate at which hydraulic fluid flows out of said hydraulic cylinder.

4. A programmable resistance device comprising:

(a) a hydraulic cylinder;

(b) a piston mounted in said cylinder for movement by a force applied to the piston;

(c) a control valve for controlling the flow of hydraulic fluid from said cylinder as said piston moves and thereby controlling the amount of resistance provided to movement of the piston;

(d) means for measuring the pressure in said cylinder to said piston;

(e) means for providing a second output which is a function of the position of the piston;

(f) drive means for controlling said valve; and (g) programmable means having as inputs said first and second outputs and providing a third output coupled as a control input to said drive means, said programmable means including means to store an array of desired velocity values as a function of position; means to derive from said second output a signal representative of velocity; means to select one of said stored values as a function of said second output; and means to compare said selected value with said signal and to provide a control output in accordance with the difference therebetween.

5. A programmable resistance device comprising;

(a) a hydraulic cylinder;

(b) a piston mounted in said cylinder for movement by a force applied to the piston;

(c) a control valve for controlling the flow of hydraulic fluid from said cylinder as said piston moves and thereby controlling the amount of resistance provided to movement of the piston;

(d) means for measuring the pressure in said cylinder to provide a first output which is a function of force applied to said piston;

(e) means for providing a second output which is a function of the position of the piston;

(f) drive means for controlling said valve; and (g) programmable means having as inputs said first and second outputs and providing a third output coupled as a control input to said drive means, said programmable means including means to store an array of desired acceleration values as a function of position; means to derive from said second output a signal representative of acceleration; means to select one of said stored values as a function of said second output; and means to compare said selected value with said signal and to provide a control output in accordance with the difference therebetween.

* * * * *